US006543261B2

(12) United States Patent
Kolton et al.

(10) Patent No.: US 6,543,261 B2
(45) Date of Patent: Apr. 8, 2003

(54) ARTICLE IDENTIFICATION AND SECURITY TAG

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NY (US)

( * ) Notice: Subject to any disclaimer, the term of this patent is extended or adjusted under 35 U.S.C. 154(b) by 0 days.

(21) Appl. No.: 09/905,019

(22) Filed: Jul. 13, 2001

(65) Prior Publication Data

US 2003/0010070 A1 Jan. 16, 2003

(51) Int. Cl.[7] ..... E05B 73/00

(52) U.S. Cl. ..... 70/57.1; 70/58; 24/30.5 P; 24/543; 292/320; 340/572.9

(58) Field of Search ..... 70/57.1, 58; 24/543, 24/30.5 P, 16 R; 340/572.8, 572.9; 292/307 R, 317–321

(56) References Cited

U.S. PATENT DOCUMENTS

| | | | | | |
|---|---|---|---|---|---|
| 1,026,701 | A | * | 5/1912 | Reid | |
| 4,361,351 | A | * | 11/1982 | Spirig | 292/321 |
| 5,437,172 | A | * | 8/1995 | Lamy et al. | 70/57.1 |
| 5,524,463 | A | * | 6/1996 | Schenkel et al. | 70/57.1 |
| 5,542,724 | A | * | 8/1996 | Netto | 292/317 |
| 5,704,097 | A | * | 1/1998 | Rahav | 292/317 X |
| 5,945,909 | A | | 8/1999 | Kolton | 340/572.1 |
| 5,969,613 | A | * | 10/1999 | Yeager et al. | 340/572.9 |
| 6,092,401 | A | * | 7/2000 | Sankey et al. | 70/18 |
| 6,098,253 | A | * | 8/2000 | Nishida et al. | 292/320 |
| 6,128,932 | A | | 10/2000 | Mainetti et al. | 70/57.1 |
| 6,157,302 | A | | 12/2000 | Kolton et al. | 340/572.7 |
| 6,226,839 | B1 | * | 5/2001 | Sayegh | 70/57.1 X |
| 6,311,531 | B1 | * | 11/2001 | Sykes | 70/57.1 |

FOREIGN PATENT DOCUMENTS

| | | | | |
|---|---|---|---|---|
| CH | 587530 | * | 5/1977 | 292/317 |
| FR | 2646198 | * | 10/1990 | 70/58 |
| GB | 775266 | * | 5/1957 | 292/317 |
| SU | 1772820 | * | 10/1992 | 24/16 R |
| WO | WO87/05277 | * | 9/1987 | 24/30.5 P |
| WO | WO91/06084 | * | 5/1991 | 292/307 R |

* cited by examiner

*Primary Examiner*—Lloyd A. Gall
(74) *Attorney, Agent, or Firm*—Robin, Blecker & Daley

(57) ABSTRACT

An EAS marker containing seal comprises a housing defining an interior recess seating an EAS marker and a latching structure adjacent an end of the housing. The housing has a flexible tail extending outwardly thereof and the tail defines a plurality of latching apertures. The housing defines an opening distal from each of the latching structure and the recess and of dimensions permitting entry of a free end of the tail into the housing members. The housing further defines an interior channel permitting movement of the tail over and beyond the EAS marker into the interior of the housing.

10 Claims, 3 Drawing Sheets

ARTICLE IDENTIFICATION AND SECURITY TAG

FIELD OF THE INVENTION

This invention relates generally to article identification and protection and pertains more particularly to seals having theft-deterrent capability.

BACKGROUND OF THE INVENTION

One type of article identification device having security aspects and having virtual universal applicability to articles is the so-called "seal", such as is shown in U.S. Pat. No. 6,128,932. The seal of the '932 patent comprises a plastic body having a flexible cord (tail) passing through and secured in the body and extending outwardly of the body to a tail free end which has a securement member affixed therewith and of hook configuration providing for irreversible insertion thereof into the body. An elongate electronic article surveillance (EAS) marker or tag is disposed in an interior recess defined within the body. The body defines detent structure for effecting retention of the securement member in the body. In addition to the body, the EAS marker and the tail, the seal of the '932 patent has plates bearing logo/article indication applied to the body to close the same.

In use of the seal, the tail is passed through an opening of an article of manufacture, e.g., a watch band of a watch, and the securement member is then inserted into the body. The EAS marker is rendered inactive at checkout of the article of manufacture.

Where fraudulent avoidance of checkout (shop-lifting) occurs, the marker is sensed by EAS systems, e.g., at store exits, and suitable alarm is generated.

Other EAS marker containing seals are shown in U.S. Pat. Nos. 5,945,909 and 6,157,302, which are commonly assigned to the assignee of the subject patent application.

SUMMARY OF THE INVENTION

The present invention has as its primary object to provide an improved EAS marker containing seal.

More particularly, the invention has as its object to provide an EAS marker containing seal which can be adapted to the size of an article to be protected thereby.

In attaining these and other objects, the invention provides an EAS marker containing seal comprising a housing defining an interior seating an EAS marker and a latching structure adjacent an end of the housing. The housing has a flexible tail extending outwardly thereof and the tail defines a plurality of latching apertures. The housing defines an opening distal from each of the latching structure and the interior recess and of dimensions permitting entry of a free end of the tail into the housing members. The housing further defines an interior channel permitting movement of the tail over and beyond the EAS marker into the interior of the housing.

In a particularly preferred embodiment, the housing defines a hinge supporting the latching structure for pivotal movement to provide access to the opening, interior walls upstanding from a floor of the housing and guiding movement of the tail into and in the housing and further interior walls depending downwardly from a ceiling of the housing and bounding the channel.

The housing may be comprised of first and second housing members peripherally secured to one another, one of the first and second housing members defining the recess, and wherein the tail is integral with the other of the first and second housing members.

In a further aspect, the invention provides, in combination, a seal comprising a housing defining an interior recess seating an EAS member and latching structure adjacent an end of the housing, a flexible tail extending outwardly of the housing and defining a plurality of latching apertures, the housing defining an opening distal from each of the latching structure and the recess and of dimensions permitting entry of a free end of the tail into the housing, the housing further defining an interior channel permitting movement of the tail over and beyond the EAS marker, and an article of manufacture, the tail being in circumscribing relation to the article of manufacture and secured therewith by the latching structure.

The invention will be further understood from consideration of the following description of preferred embodiments thereof and from the drawings where like reference numerals identify like parts throughout.

DETAILED DESCRIPTION OF PREFERRED EMBODIMENTS

Referring to FIGS. 1–4, the seal of the invention is constituted by EAS marker 10, first housing member 12 and second housing member 14. Members 12 and 14 are preferably one-piece molded plastic bodies.

Figure 1:
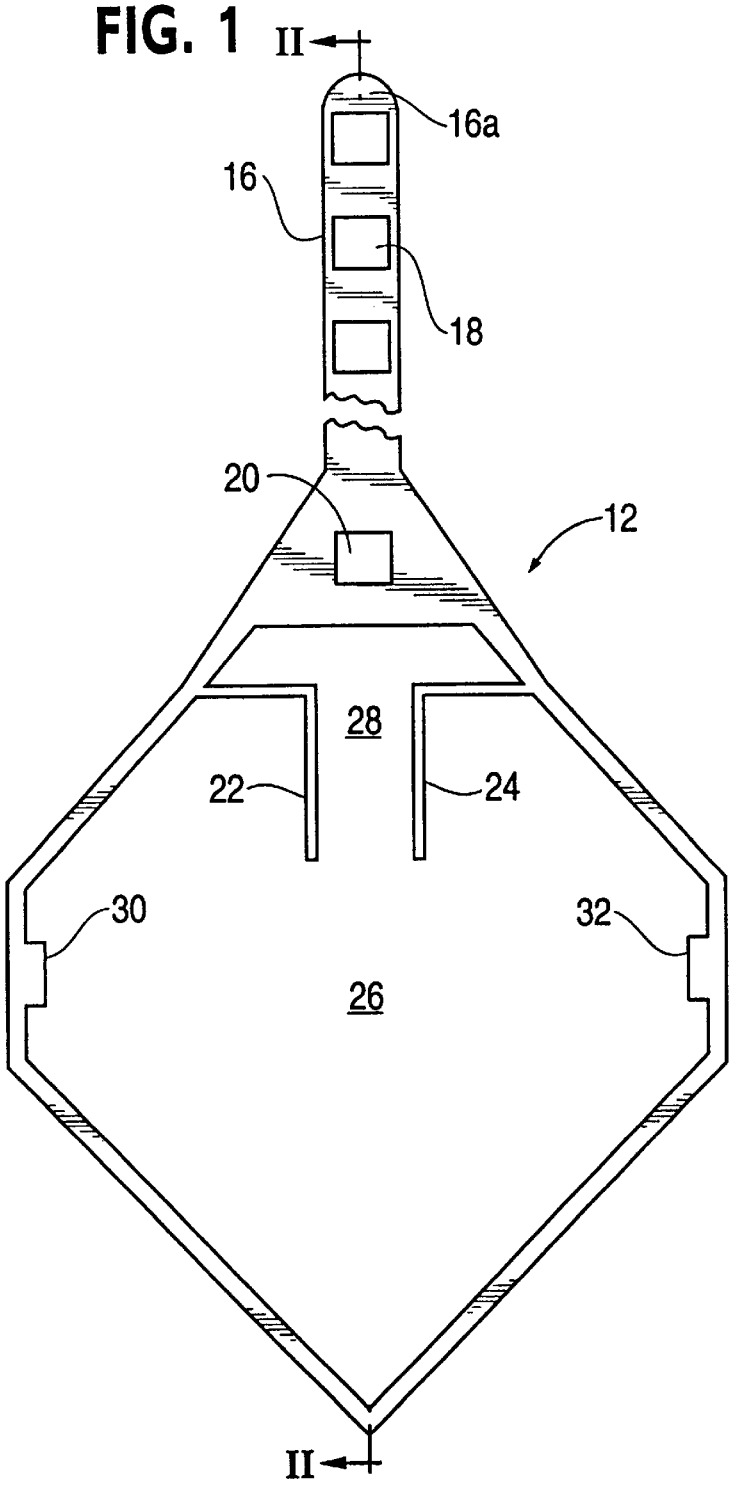
FIG. 1 is a top plan elevation of a first housing member in accordance with the invention.
Figure 2:
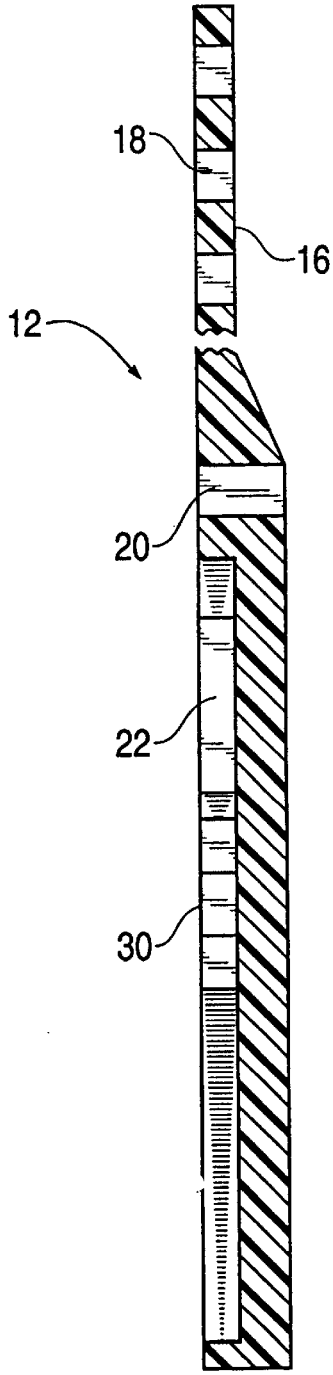
FIG. 2 is a sectional view as would be seen from plane II—II of FIG. 1.

As is seen in FIGS. 1 and 2, first housing member 12 has tail 16 extending outwardly thereof, the tail having a plurality of latching apertures 18. Detent opening 20 is formed in first housing member 12 adjacent tail 16 as are L-shaped walls 22 and 24 which extend upwardly from floor 26 and define channel 28, which is open upwardly and downwardly in FIG. 1. Housing member 12 further includes assembly lugs 30 and 32.

Figure 3:
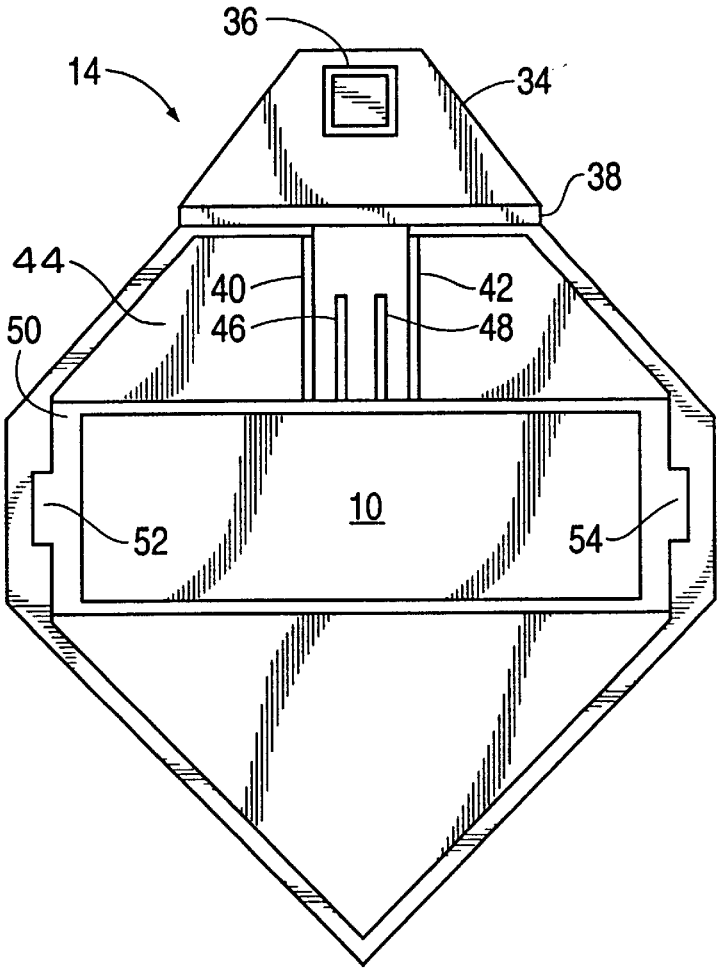
FIG. 3 is a top plan elevation of a second housing member in accordance with the invention.
Figure 4:
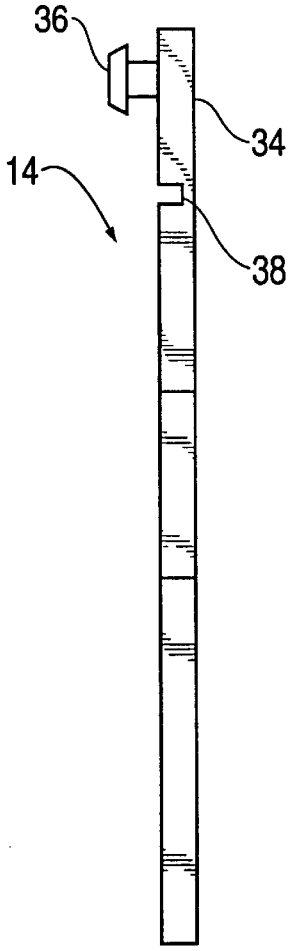
FIG. 4 is a right side elevation of FIG. 3.

Referring to FIGS. 3 and 4, second housing member 14 defines an upper latching part 34 having latching hook 36 extending outwardly thereof, latching part being supported by hinge 38.

L-shaped walls 40 and 42 extend upwardly from floor 44 laterally aside straight walls 46 and 48, also extending upwardly from floor 44. Recess 50 is formed in floor 44 and EAS marker 10 is seated in recess 50. Second housing member further defines assembly slots 52 and 54.

In assembling the seal, housing member 12 is placed atop housing member 14, with lugs 30 and 32 nesting in slots 52 and 54. The peripheries of the housing members are then secured to one another, preferably by heat sealing.

Figure 5:
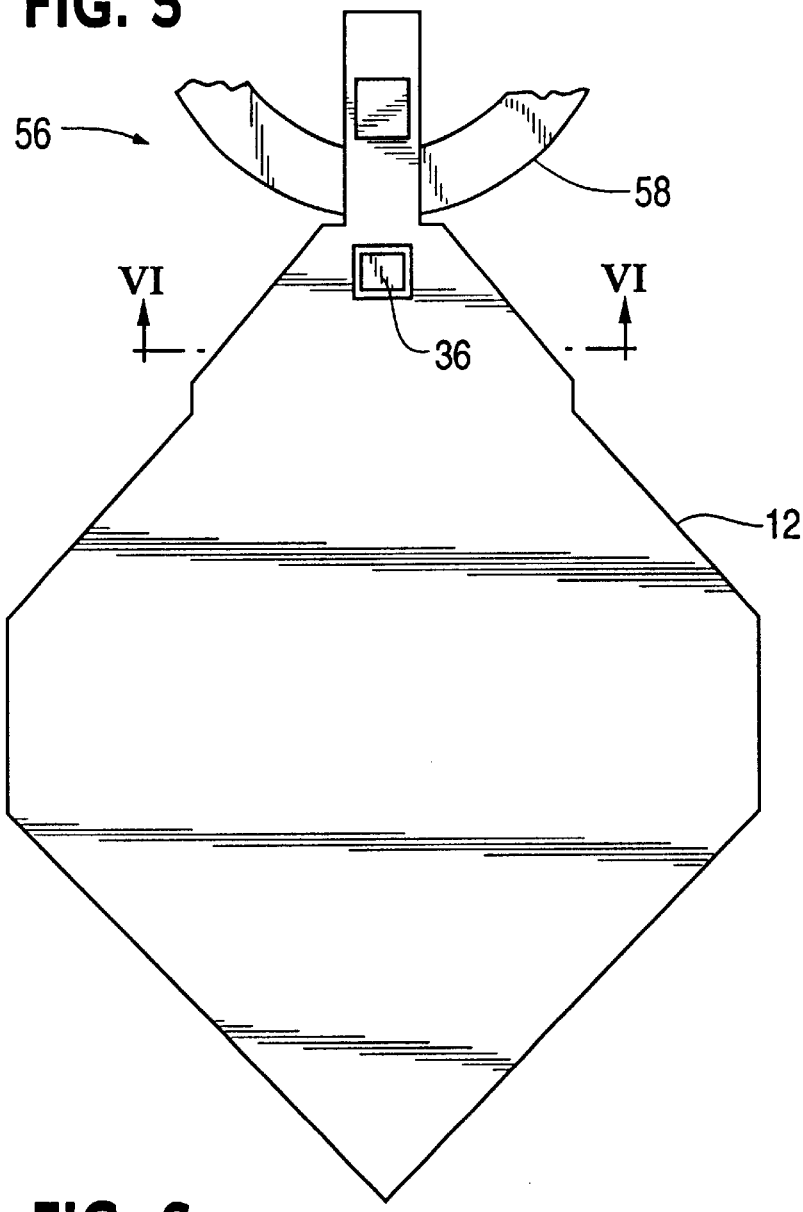
FIG. 5 is a top plan view of a seal of the invention in assembly with a portion of an article to be protected thereby.

In FIG. 5, assembled seal 56 is shown in engagement with article of manufacture 58, e.g., a bracelet. In reaching the FIG. 5 assembly, tail 16 is wrapped about article 58 and latching part 34 is pivoted about hinge 38 (FIG. 3) to permit the free end 16*a* (FIG. 1) of tail 16 to be inserted into channel 28 (FIG. 1). Tail 16 is then further pushed through channel 28 until the tail is in tightly circumscribing relation to article 58. Latching hook 36 (FIG. 3) is then forced into the one of apertures 18 then in registry with detent opening 20 (FIG. 1) until latching hook abuts on the outer (rear) surface of housing member 12, thereby securing seal 56 with article 58.

Figure 6:
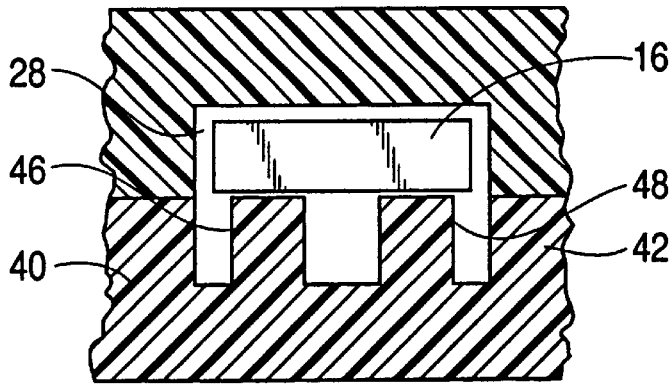
FIG. 6 is a partial sectional view as would be seen from plane VI—VI of FIG. 5.

As is seen in the partial sectional view of FIG. 6, tail 16 (shown unsectioned) rides in channel 28 atop straight walls 46 and 48 interiorly of L-shaped walls 22 and 24. Walls 46 and 48 extend upwardly of EAS marker 10, thereby permitting movement of tail 16 over and beyond EAS marker 10 into the open interior of housing member 12, i.e., in non-interfering relation to EAS marker 10.

Various changes may be introduced in the disclosed preferred embodiment and practices without departing from the invention. Accordingly, it is to be appreciated that the true spirit and scope of the invention is set forth in the following claims.

What is claimed is:

1. A seal comprising a housing defining an interior recess seating an EAS marker and latching structure extending outwardly of an end of the housing, a flexible tail extending outwardly of said housing and defining a plurality of latching apertures, said housing defining an opening distal from each of said latching structure and said recess and of dimensions permitting entry of a free end of said tail into the housing, said housing further defining an interior channel permitting movement of said tail over and beyond said EAS marker.

2. The seal claimed in claim 1, wherein said housing defines a hinge supporting said latching structure for pivotal movement to provide access to said opening.

3. The seal claimed in claim 1, wherein said housing defines interior walls upstanding from a floor of said housing and guiding movement of said tail into and in said housing.

4. The seal claimed in claim 1, wherein said housing defines interior walls depending downwardly from a ceiling of said housing and bounding said channel.

5. The seal claimed in claim 2, wherein said housing defines interior walls upstanding from a floor of said housing and guiding movement of said tail into and in said housing.

6. The seal claimed in claim 2, wherein said housing defines interior walls depending downwardly from a ceiling of said housing and bounding said channel.

7. The seal claimed in claim 3, wherein said housing defines further interior walls depending downwardly from a ceiling of said housing and bounding said channel.

8. The seal claimed in claim 1, wherein said housing is comprised of first and second housing members peripherally secured to one another.

9. The seal claimed in claim 8, wherein one of said first and second housing members defines said recess and wherein said tail is integral with the other of said first and second housing members.

10. In combination:

a seal comprising a housing defining an interior recess seating an EAS marker and latching structure extending outwardly of an end of the housing, a flexible tail extending outwardly of said housing and defining a plurality of latching apertures, said housing defining an opening distal from each of said latching structure and said recess and of dimensions permitting entry of a free end of said tail into the housing, said housing further defining an interior channel permitting movement of said tail over and beyond said EAS marker; and an article of manufacture, said tail being in circumscribing relation to said article of manufacture and secured therewith by said latching structure.

* * * * *